US008061365B2

(12) United States Patent
Rehkemper et al.

(10) Patent No.: US 8,061,365 B2
(45) Date of Patent: Nov. 22, 2011

(54) AUTOMATED NAIL POLISHING DEVICE

(75) Inventors: Steven Rehkemper, Chicago, IL (US); Jeffrey Rehkemper, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 124 days.

(21) Appl. No.: 12/726,552

(22) Filed: Mar. 18, 2010

(65) Prior Publication Data

US 2010/0252058 A1 Oct. 7, 2010

Related U.S. Application Data

(60) Provisional application No. 61/161,264, filed on Mar. 18, 2009.

(51) Int. Cl.
*A45D 29/05* (2006.01)

(52) U.S. Cl. ..... 132/73.6; 700/258; 700/259

(58) Field of Classification Search ..... 132/73.6, 132/75.3, 75.6, 75.8, 73, 74.5, 76.4, 76.5; 74/490.01–490.03, 490.05–490.06; 318/568.11, 318/568.14, 568.17, 568.2, 568.21, 543, 318/549; 901/15, 47, 41; 700/245, 258, 700/253, 264

See application file for complete search history.

(56) References Cited

U.S. PATENT DOCUMENTS

| | | | | |
|---|---|---|---|---|
| 4,864,966 | A * | 9/1989 | Anderson et al. | 427/265 |
| 5,298,844 | A * | 3/1994 | Nagasaki et al. | 318/568.11 |
| 5,645,884 | A * | 7/1997 | Harlow et al. | 427/8 |
| 6,286,517 | B1 * | 9/2001 | Weber et al. | 132/73 |
| 6,366,694 | B1 * | 4/2002 | Acharya | 382/167 |

FOREIGN PATENT DOCUMENTS

GB 2344776 A * 6/2000

* cited by examiner

*Primary Examiner* — Todd Manahan
*Assistant Examiner* — Jennifer Gill

(57) ABSTRACT

An automated nail polishing is provided. The device includes an arm having a plurality of linkages rotatably connected to each other. The end of the arm includes a port to removably receive a brush. The linkages are capable of controlled movement through an integrated circuit and motors. A hand platform is also provided with a groove and sensor for receiving a user finger. When the finger is placed in the groove, the integrated circuit can move the arm to dip the brush into a liquid receptacle and then move the arm to brush the liquid onto a user's fingernail.

7 Claims, 15 Drawing Sheets

AUTOMATED NAIL POLISHING DEVICE

FIELD OF THE INVENTION

The present invention relates generally to an automated nail polishing device, and more particularly to an automated device that utilizes a programmable arm to apply polish to fingernails or toenails.

BACKGROUND OF THE INVENTION

Finger nail polish and polishing implements are well known within the art. Presently, nail polish used for manicures and pedicures is sold in predominantly glass containers with the applicator formed as an appendage to the bottle cap. The present invention seeks to improve upon the prior art by providing an automated nail polishing device.

SUMMARY OF THE INVENTION

There is provided an automated nail polishing device. The device in one embodiment includes a base, hand rest, and movable arm. The hand rest is secured to the base and may be adjustable. The hand rest further includes one or more grooves that when a user places its finger in a groove this triggers a sensor. The movable arm is attached to a horizontally rotatable cap that is attached to the base. The movable arm is pivotally secured at a lower end to the cap and includes an upper end that is capable of receiving removable attachments including a brush attachment. The base also includes a receptacle for holding a liquid, such as nail polish. The device further includes an integrated circuit that controls the movable arm and cap such that when a user places its finger in the groove, triggering the sensor, the integrated circuit can control the movement of the brush to dip it into the receptacle and then apply the liquid in brush strokes onto the finger nail.

To facilitate the movement of the arm and cap, the integrated circuit would be controlling multiple motors and in a preferred embodiment a plurality of arm linkages that make up the arm itself.

Various other embodiments would include providing an adjustable hand rest, multiple grooves to accommodate different fingers or thumbs, and different attachments, such as nail filers or nail buffers. A light may also be provided at the end of the arm to help identify the brush strokes so the user may adjust the finger appropriately.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1A:
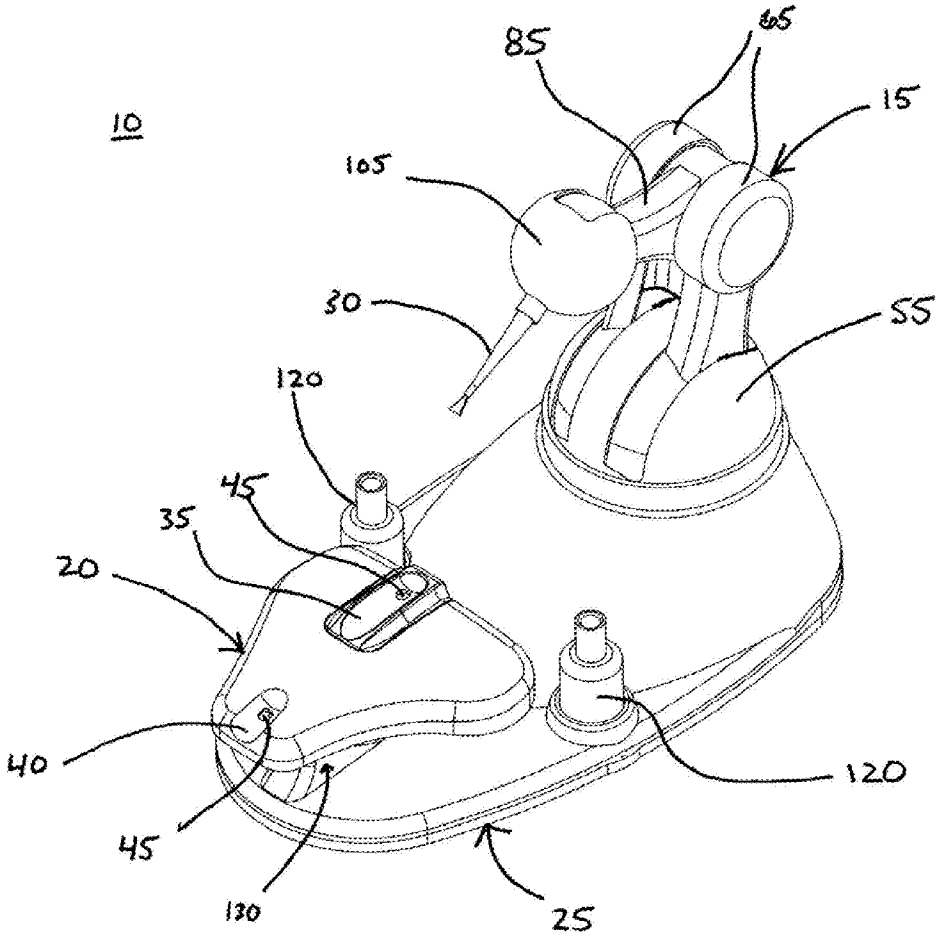
FIG. 1*a* is a front left perspective view of a device in accordance with an embodiment of the present invention.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention and the embodiments illustrated.

Figure 1B:
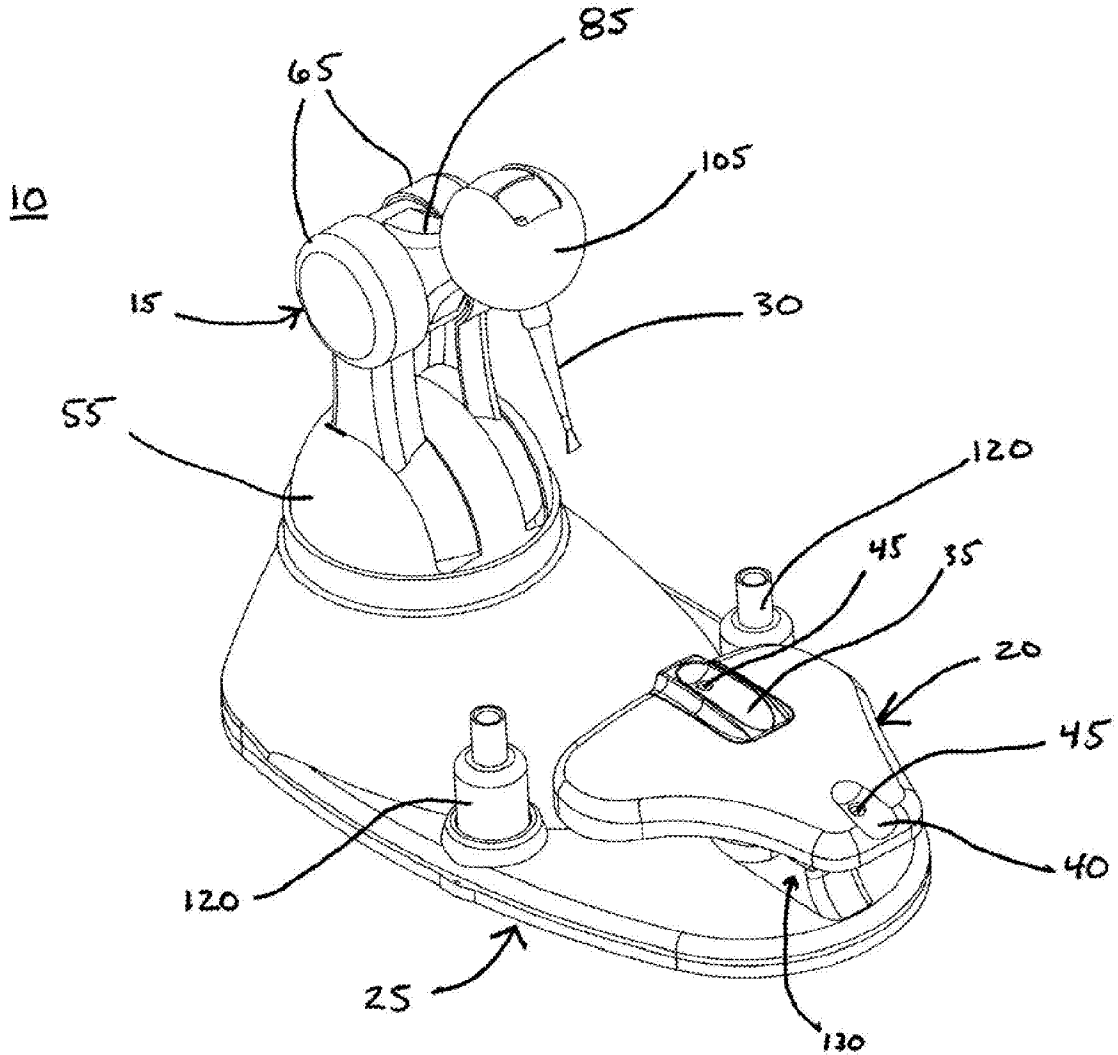
FIG. 1*b* is a front right perspective view of the device from FIG. 1*a;*

Referring now to FIGS. 1*a* and 1*b*, in accordance to an embodiment of the present invention, there is illustrated a finger nail polishing device 10 that includes an arm mechanism 15, an adjustable hand rest 20 and a base 25. In this embodiment, the device 10 uses servos and/or motors to move a series of linkages included in the arm mechanism 15 via preprogrammed content to direct a brush 30 to execute a series of brush strokes to paint or polish a user's nails. While an embodiment herein may be described as utilizing servos, it is understood that the utilization of motors or other similar driving components would not alter the scope of the invention.

The hand rest 20 includes a first positioning groove 35 for finger placement and a second positioning groove 40 for thumb placement. Sensors 45 at the base of each groove are triggered when a finger or thumb is positioned in either groove, respectively. Triggering one of two sensors 45 sends a signal to an integrated circuit (IC) to prompt an IC response for facilitation of the preprogrammed content (described below) to direct the servos and linkages to move the brush 30. While this embodiment includes three linkages and four servos, a plurality of linkages and servos may be used to move the brush 30.

Figure 1C:
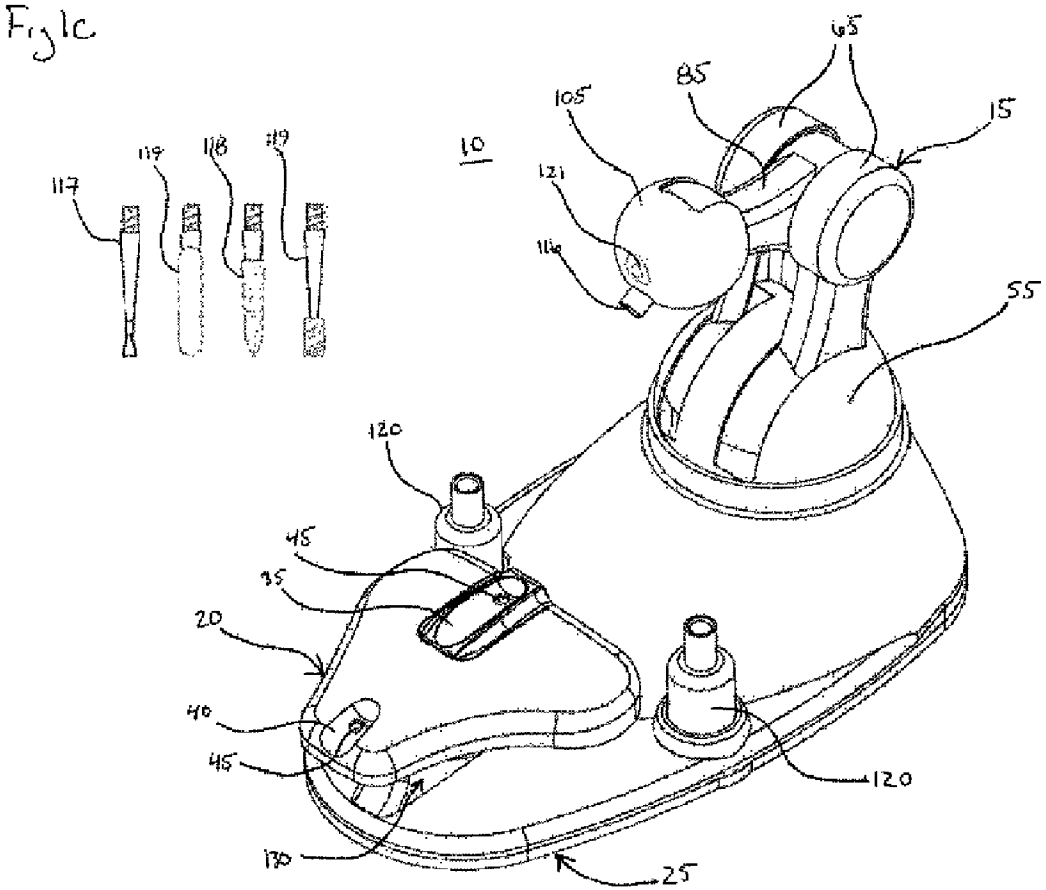
FIG. 1C is a front right perspective view of the device from FIG l*a* illustrating removable attachments.
Figure 2A:
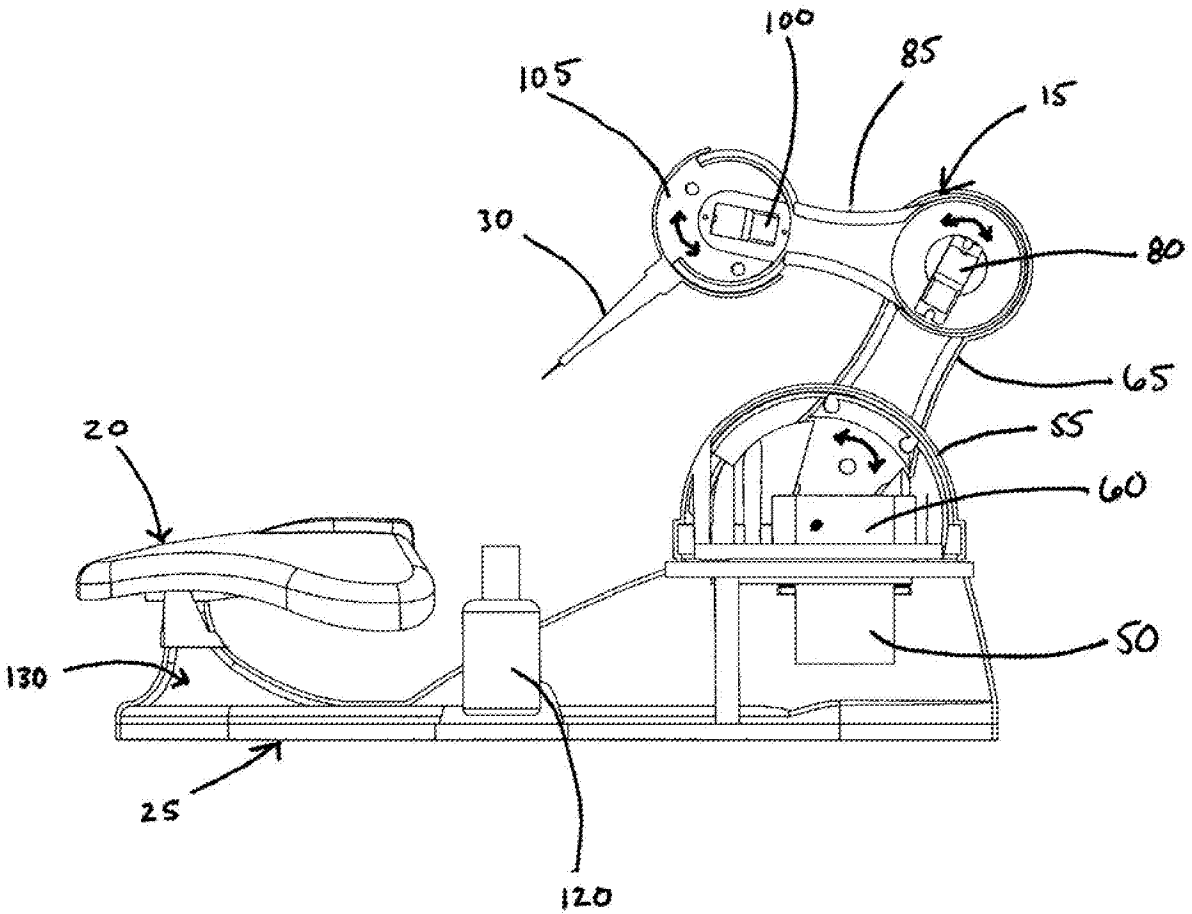
FIG. 2*a* is a side view of the device from FIG. 1*a* in accordance with one embodiment of the present invention where portions of the housing are removed to show components of the device.
Figure 2B:
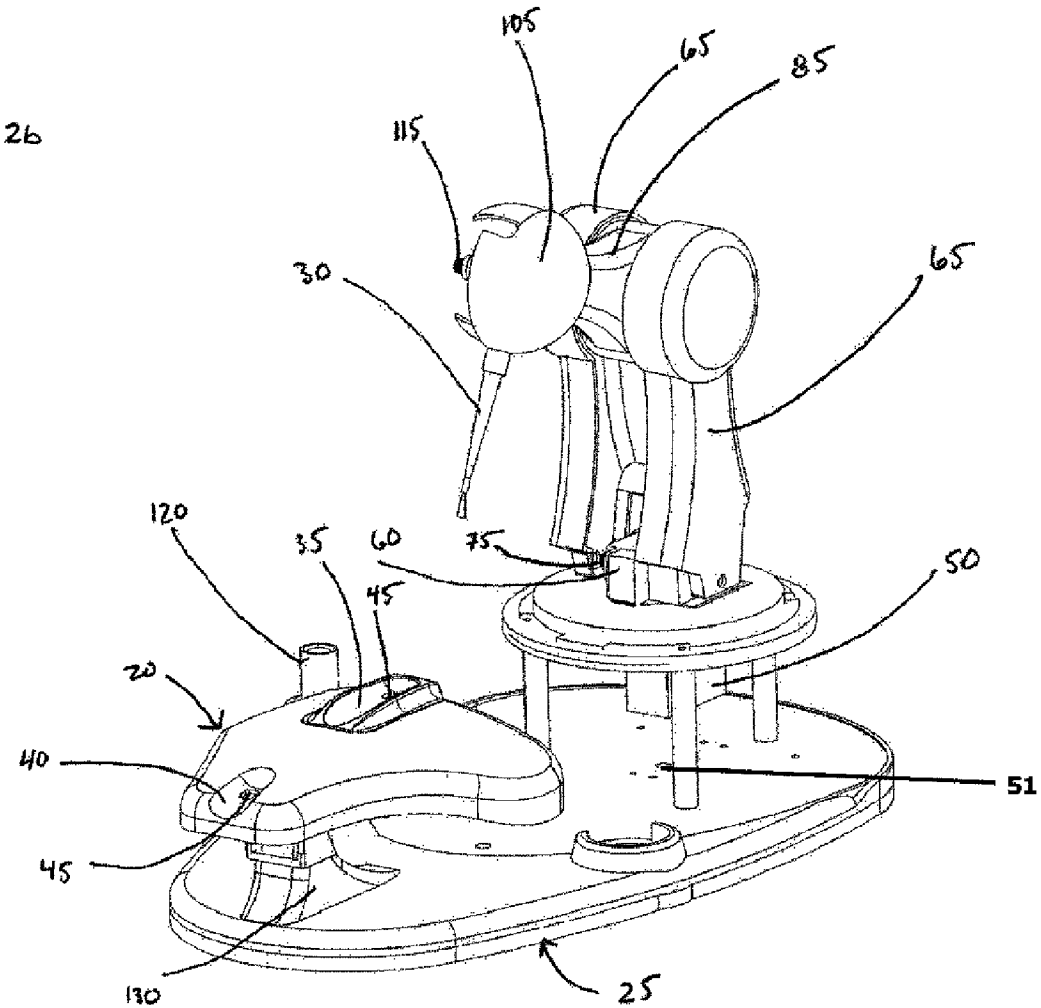
FIG. 2*b* is a perspective view of the device from FIG. 1*a* where portions of the housings are removed to show components of the device.
Figure 2C:
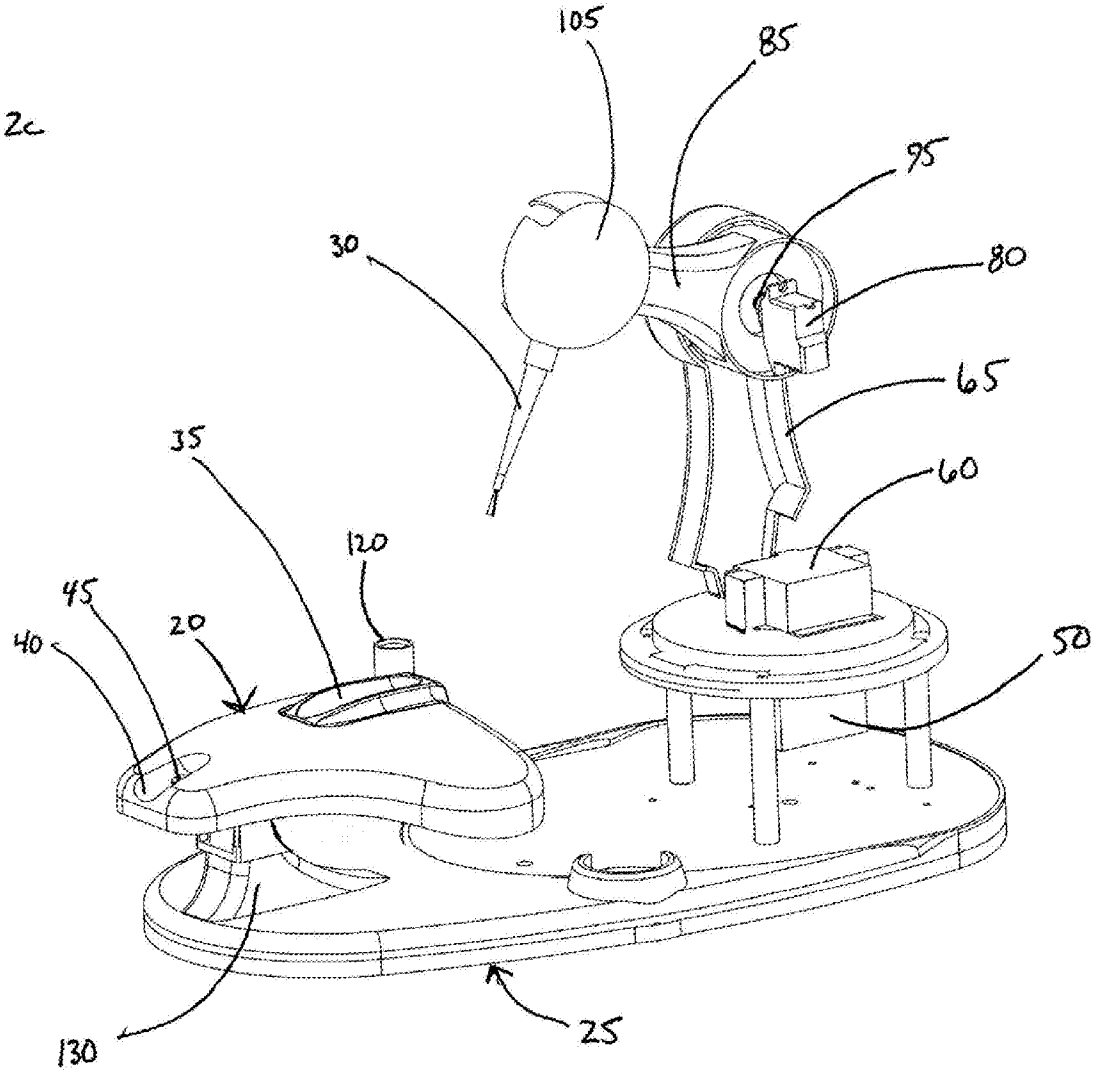
FIG. 2*c* is a perspective view of the device from FIG. 1*a* where portions of the housings are removed to show components of the device.
Figure 2D:
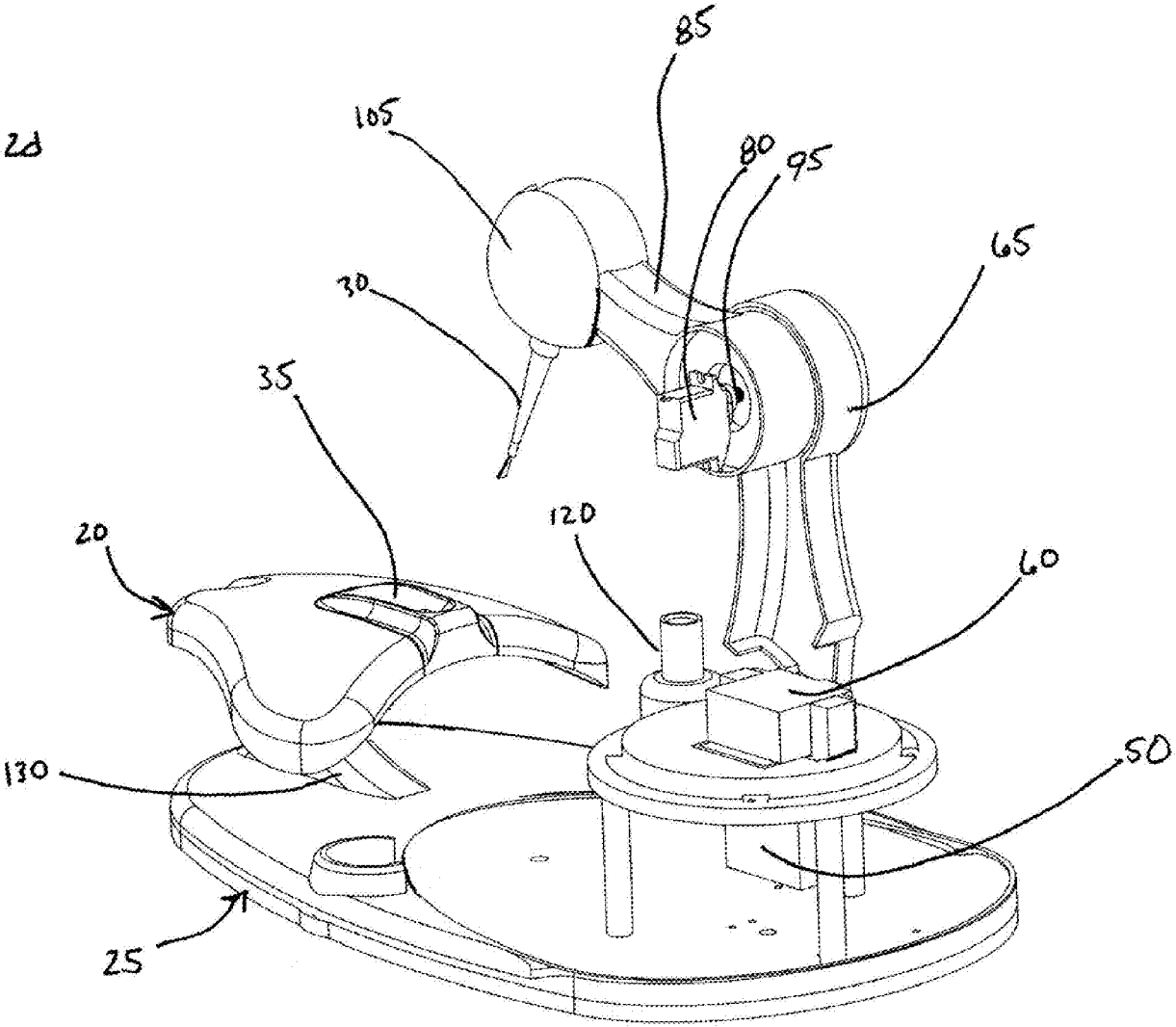
FIG. 2*d* is a perspective view of the device from FIG. 1*a* where portions of the housings are removed to show components of the device.
Figure 2E:
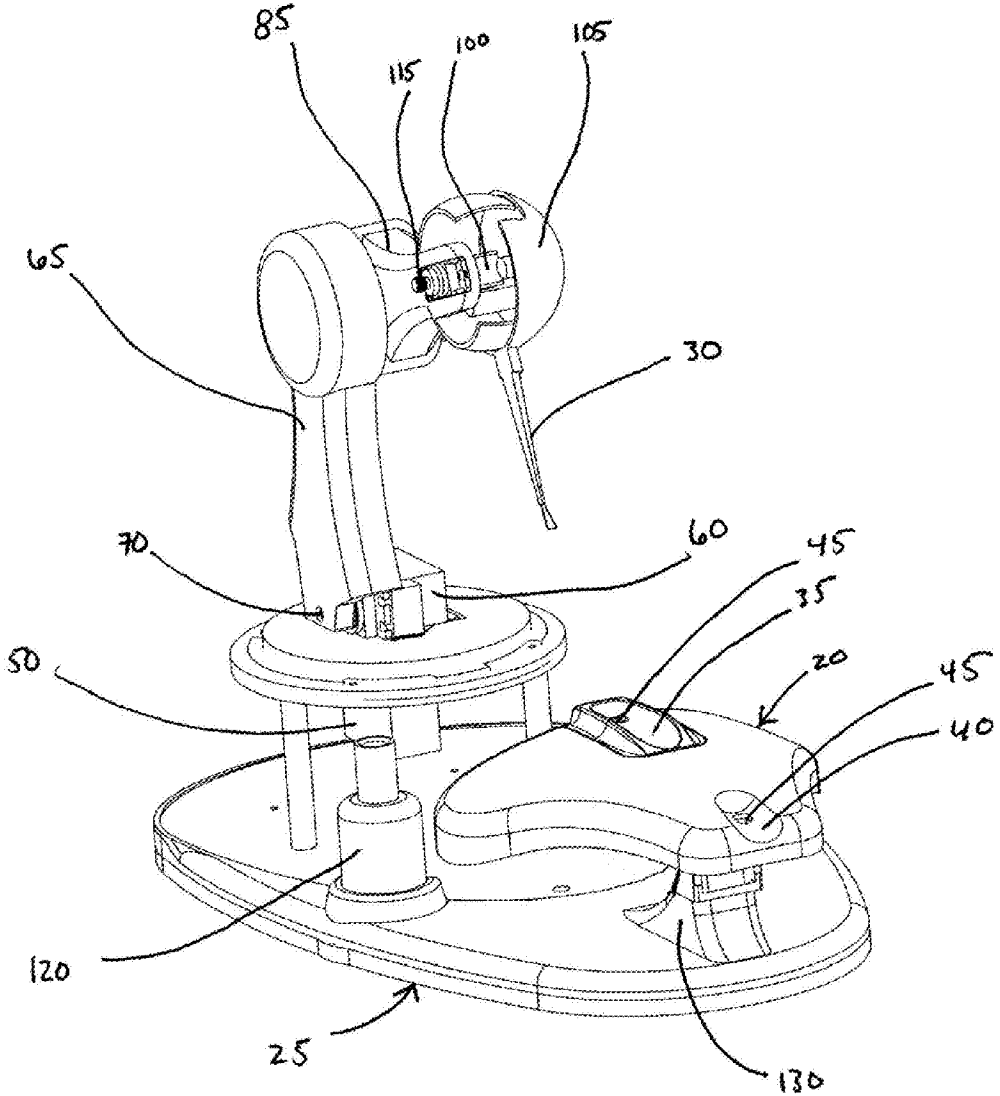
FIG. 2*e* is a perspective view of the device from FIG. 1*a* where portions of the housings are removed to show components of the device.
Figure 2F:
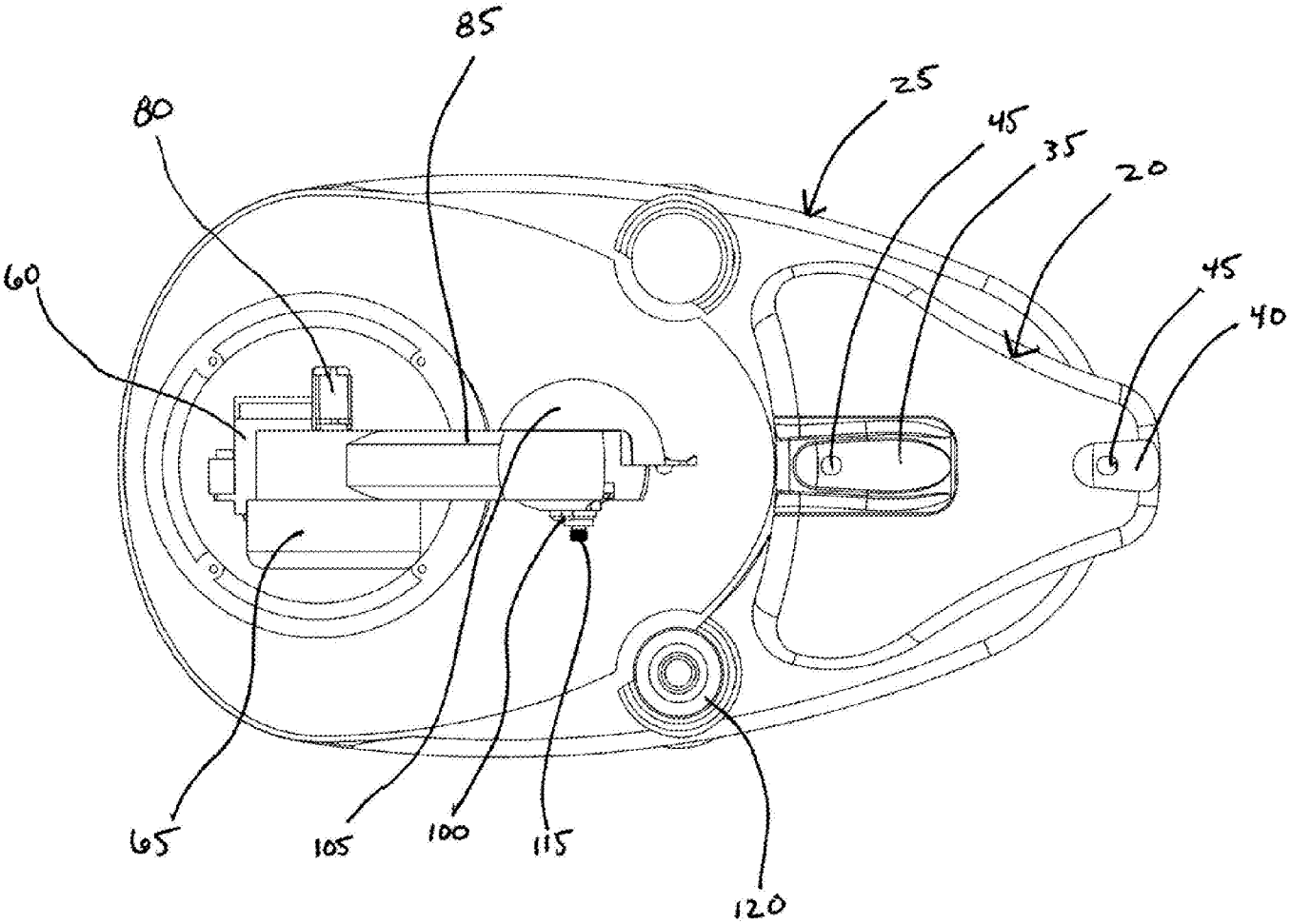
FIG. 2*f* is a top view of FIG. 2*e;*

As further shown in FIG. 1C the device 10 further includes a port 116 to receive attachments, such as but not limited to, a brush 117, different types of nail filers 119, or a nail buffer 118. The ends of which can be removably received into the port 116. In addition thereto, the arm mechanism 15 can include a light source 121 which is illustrated as providing light from the third linkage 105 and would be directed to aid a user with visual alignment when using one of the attachments.

Now referring to FIGS. 2*a*-2*f*, a base servo 50 is housed within the base 25 and is rotatably attached to a cap 55 such that powering the base servo 50 rotates the cap 55 in a clockwise or counterclockwise direction as desired. The cap 55 is further secured to the arm mechanism 15. As such, rotation of the cap 55 rotates the arm mechanism 15 attached thereto.

The cap 55 houses a first servo 60 , or cap servo, fixed to the cap 55 and rotatably attached to one end of a first linkage 65 with a threaded port 70 to receive a first servo gear 75 to rotate the first linkage 65 when the first servo 60 is powered in either direction. A second servo 80 is housed within the other end of the first linkage 65 and is fixed thereto. The second servo 80 is rotatably attached to one end of a second linkage 85 and includes a threaded port 90 to receive a second servo gear 95 to rotate the second linkage 85 when the second servo 80 is powered in either direction. A third servo 100 is housed within the other end of the second linkage 85 and is fixed thereto. The third servo 100 is rotatably attached to a third linkage 105 with a threaded port 110 to receive a third servo gear 115 to transfer rotation to the third linkage 105 when the third servo 100 is powered in either direction. The third linkage also includes a threaded port to receive varying attachments, here shown as a brush. The brush 30 moves in accordance with the rotation of the third linkage 105 to facilitate actions such as brush strokes for polishing a finger nail. Other examples of attachments for use with the device 10 include a nail filer and nail buffer. Each of the different attachments may use any number of removable connecting means known in the art without deviating from the scope of the present invention.

Figure 3A:
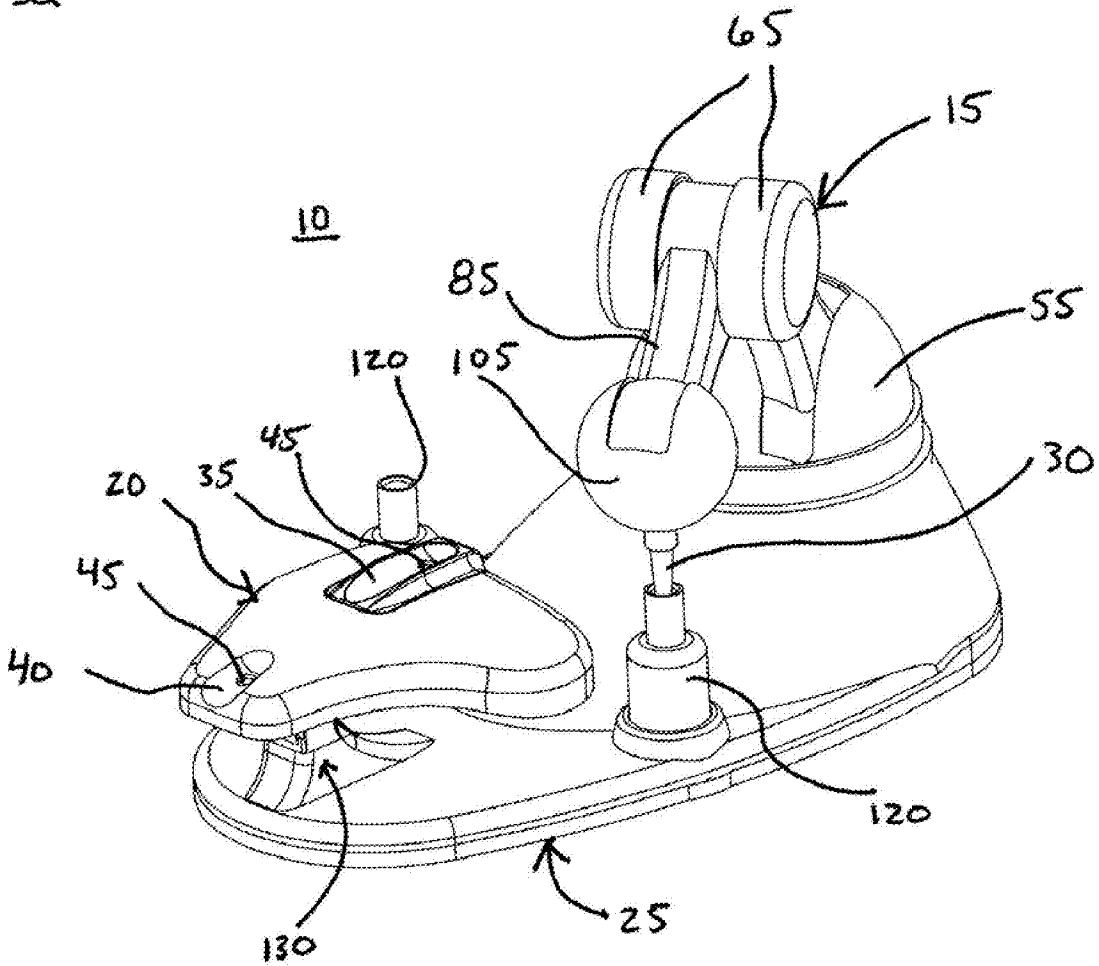
FIG. 3*a* is a perspective view of the device from FIG. 1*a* in accordance with one embodiment of the present invention illustrating the arm mechanism dipping the brush in a receptacle.
Figure 3B:
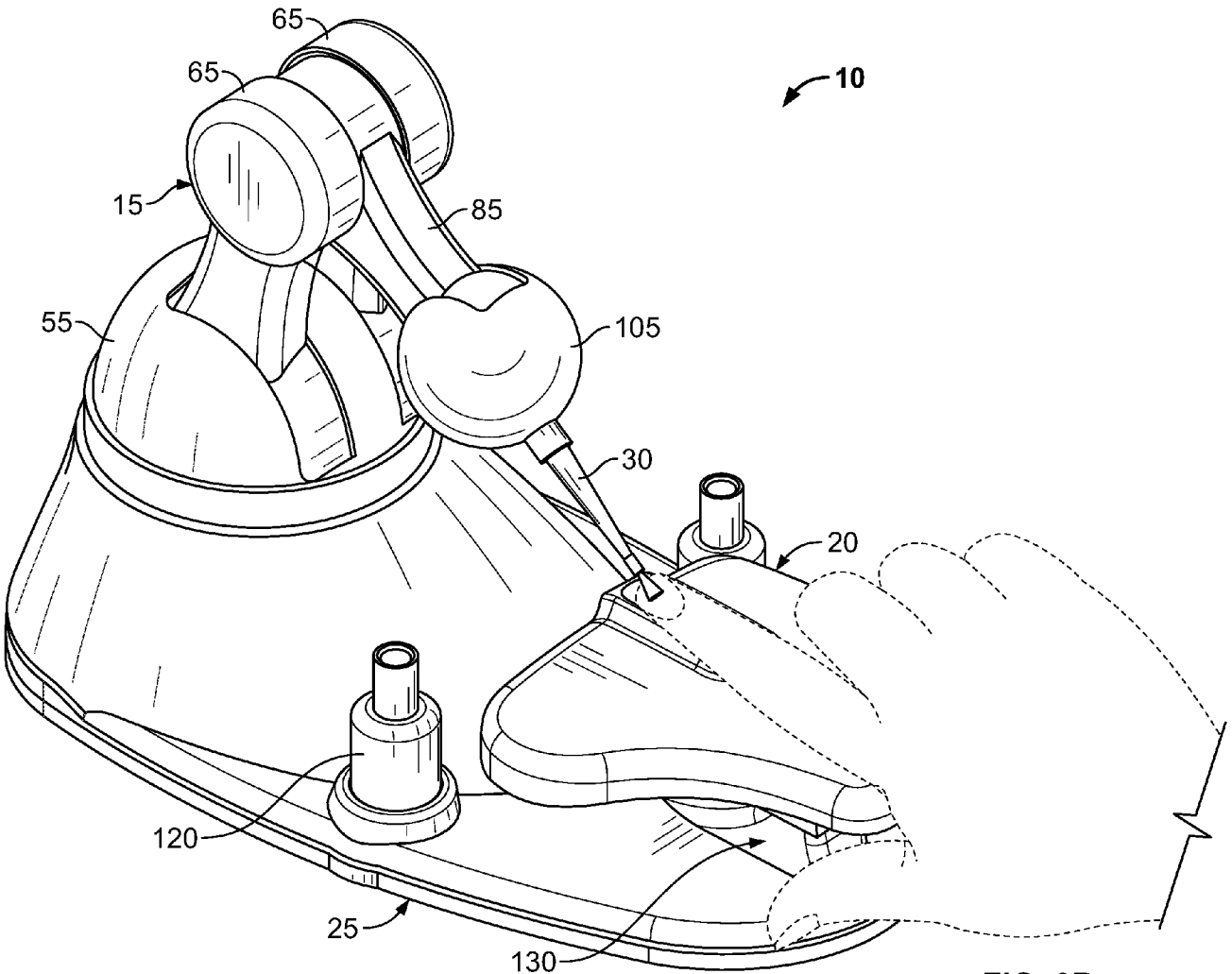
FIG. 3*b* is a perspective view of the device from FIG. 1*a* in accordance with one embodiment of the present invention illustrating the arm mechanism positioning the brush on a finger nail for polishing.
Figure 3C:
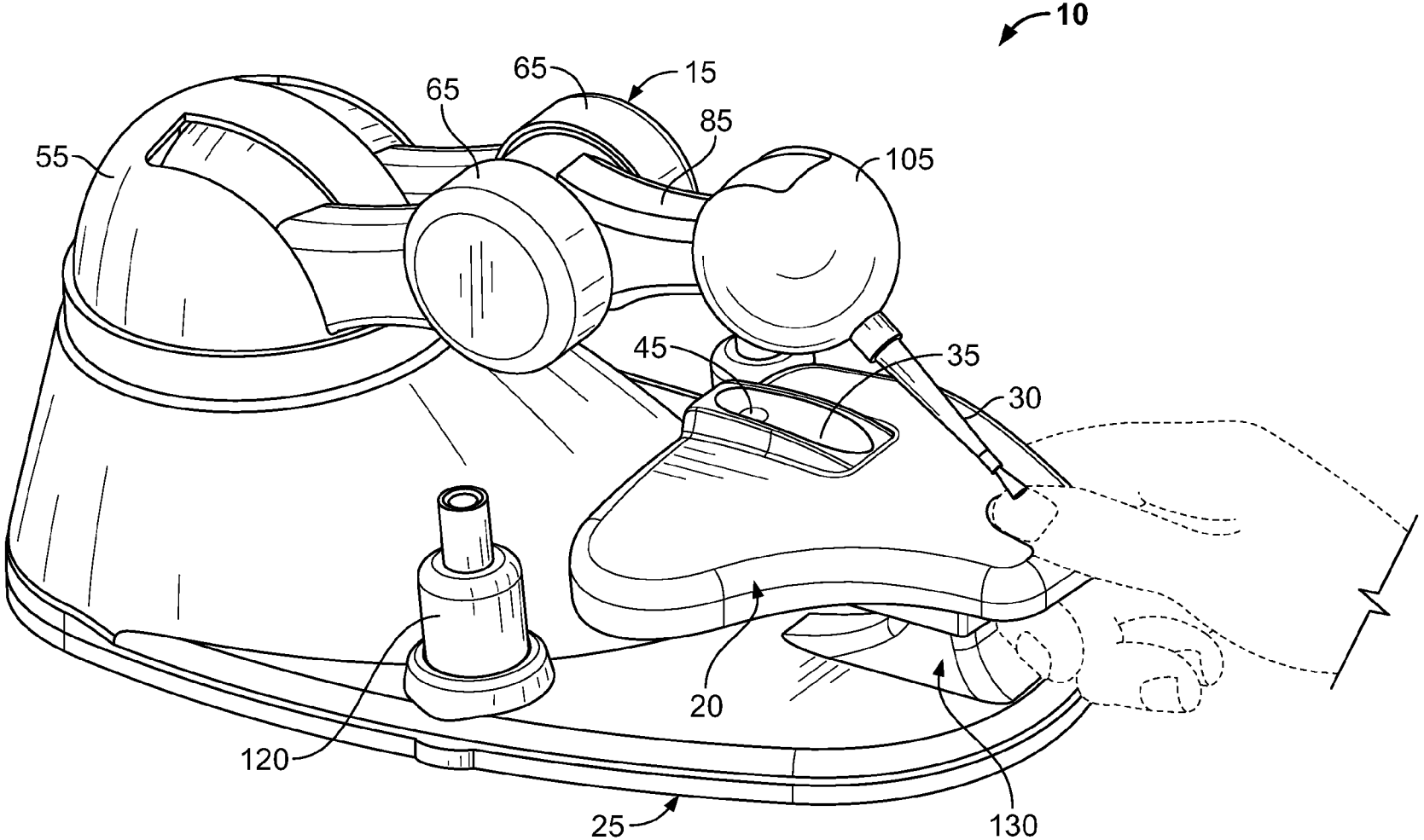
FIG. 3*c* is a perspective view of the device from FIG. 1*a* in accordance with one embodiment of the present invention illustrating the arm mechanism positioning the brush on a thumb nail for polishing.

A polishing action is shown in FIGS. 3*a*-3*c*. To initiate the polishing action, the IC directs power to the base servo 50 to rotate the cap 55 in either a clockwise or counterclockwise direction to position the brush 30 in line with a polish receptacle 120. The IC then directs power distribution to the servos to position the arm mechanism 15 to dip the brush 30 into the receptacles 120 as seen in FIG. 3*a*. In addition to including nail polish in the receptacle 120, various liquids may be used without departing from the scope of this invention, such as nail strengthener. The size and positioning of the receptacles may also vary as the programming included in the IC may direct the arm mechanism 15 to dip the brush 30 in any number of receptacle 120 size variations and locations. Once the brush 30 is dipped in polish, the servos power in accordance to preprogrammed content to move the linkages to position the brush 30 above the finger or thumb positioned on the hand rest 20 as shown in FIGS. 3*b* and 3*c*. The IC then directs the brush 30 to execute a series of brush strokes to apply the polish to the nail. A targeting means may also be included for fine tuning the positioning of the brush 30 in relation to the nail. For example, a targeting light (not shown) secured to the brush 30 can direct a user to adjust the finger positioning by using light to indicate the path of the brush strokes. As such, users with varying sizes of fingers or nails may assist the device 10 in successfully polishing the desired area of the nail.

Figure 4A:
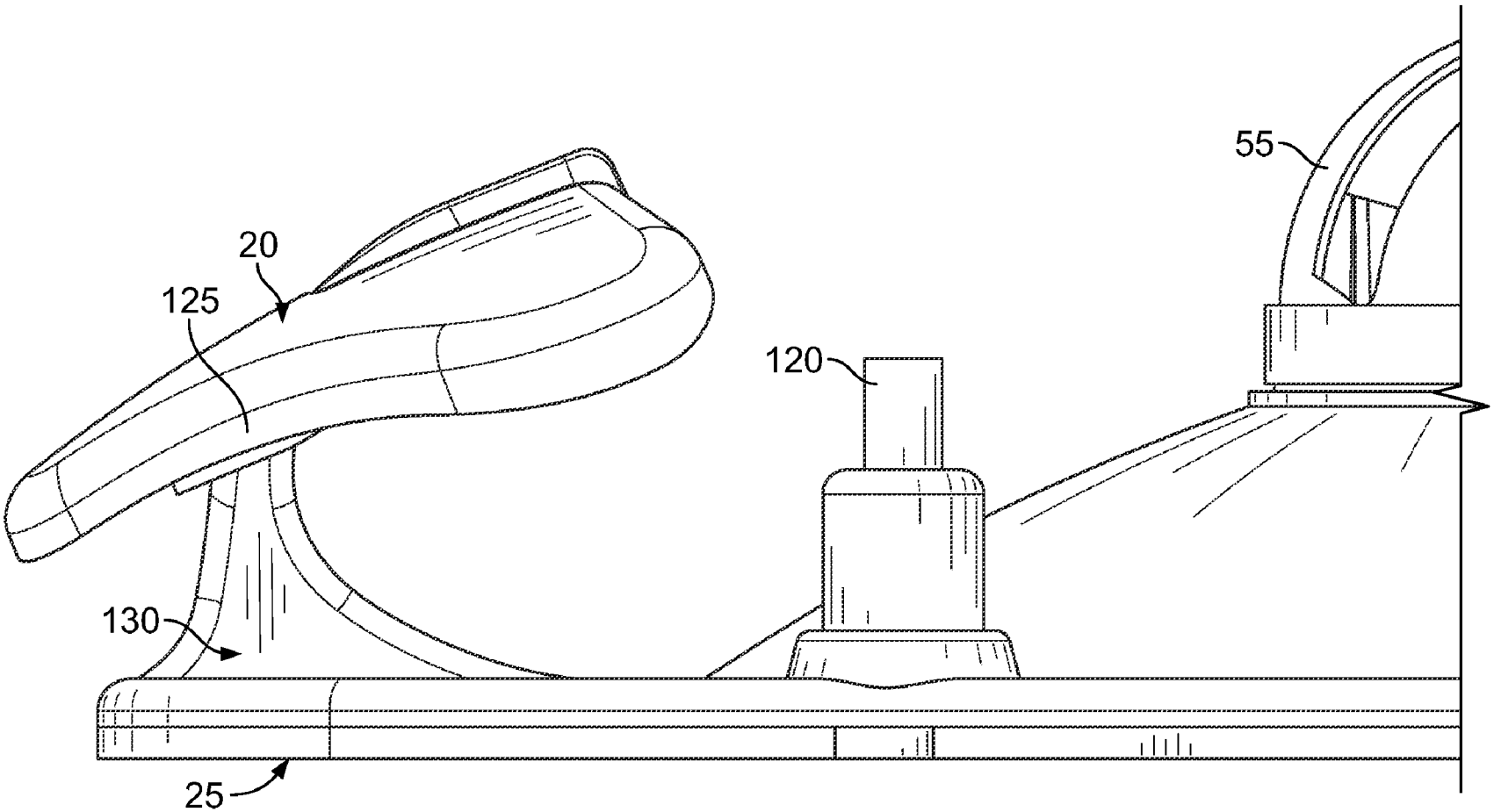
FIG. 4*a* is a detailed side view of the hand rest from the device from FIG. 1*a* where the front end of the hand rest is adjusted upward.
Figure 4B:
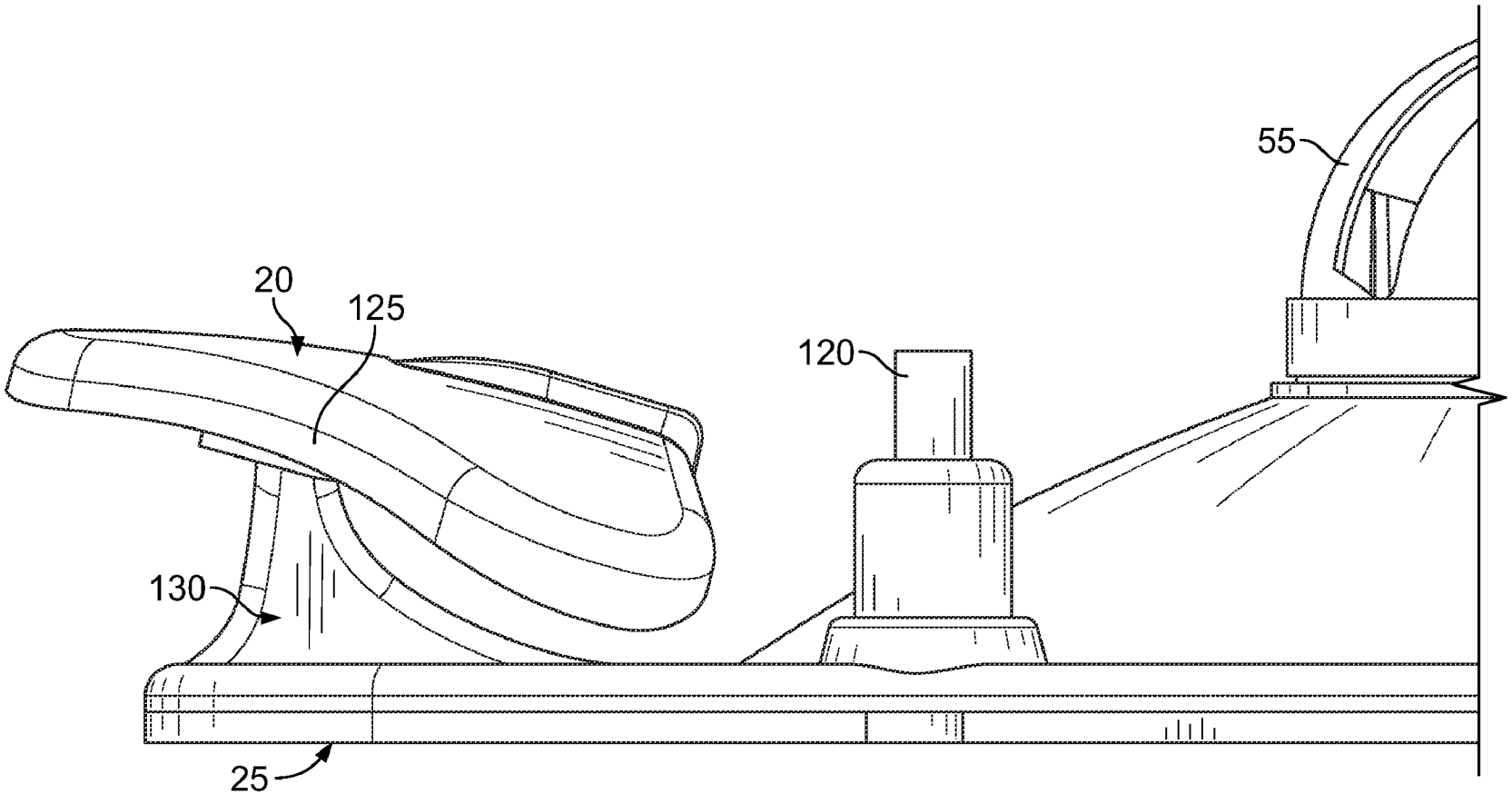
FIG. 4*b* is a detailed side view of the hand rest from the device from FIG. 1*a* where the front end of the hand rest is adjusted downward.

Referring now to FIGS. 4*a* and 4*b*, the hand rest 20 includes the positioning grooves and sensors 45 as described above. Further, the hand rest 20 may adjust in a vertical direction (vertical adjustability not shown) and about an axis 125 to a user's desired hand positioning. A stem 130 is fixed to the base 25 and is rotatably to the hand rest 20 such that the hand rest rotates about an axis 125. The stem 130 may also have a telescoping capability for vertical adjustments.

Figure 5:
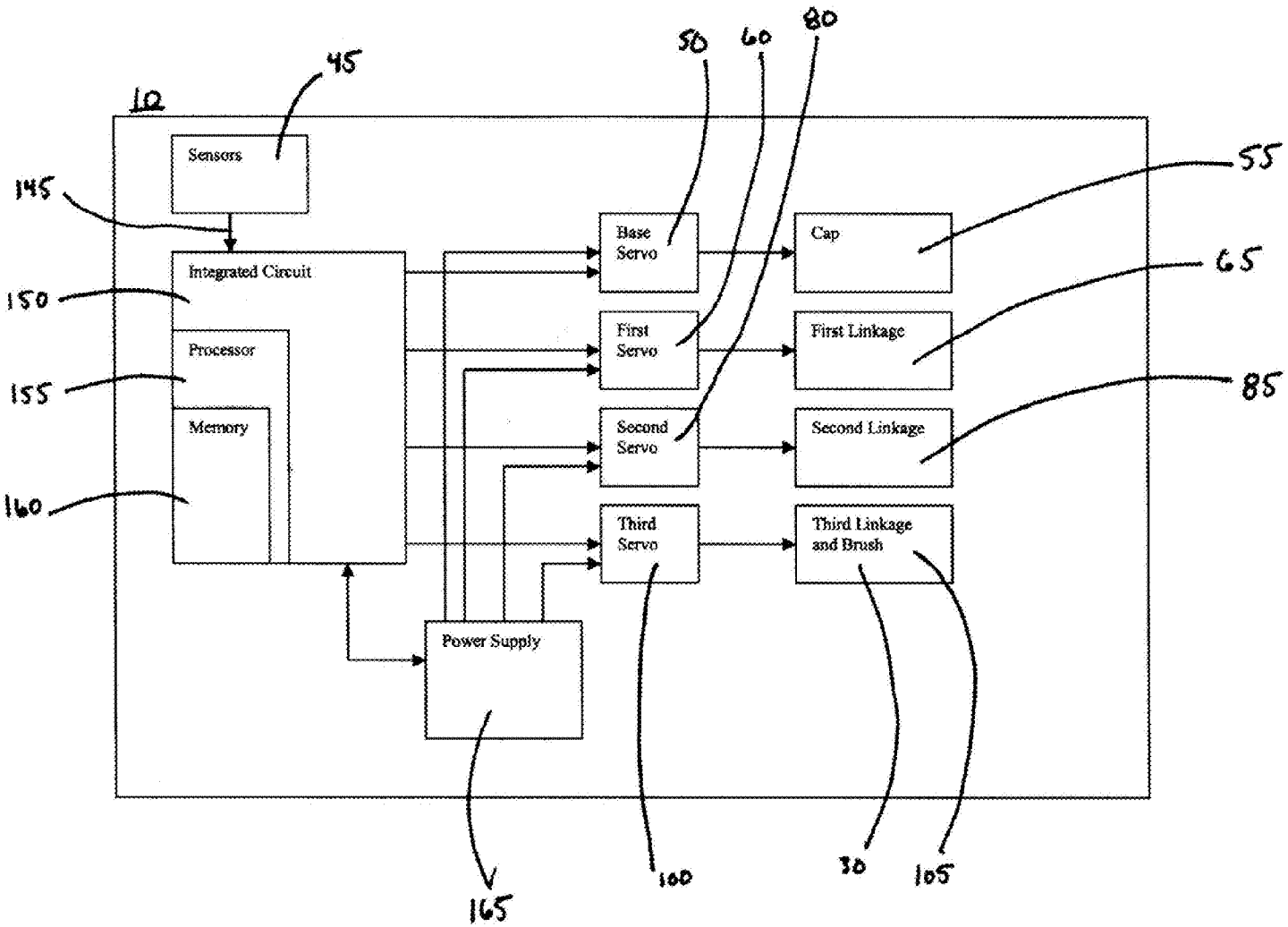
FIG. 5 is a block diagram of the device from FIG. 1*a* in accordance with an embodiment of the present invention.

Referring now to FIG. 5, there is shown a block diagram provided for an embodiment of the device 10. When one of the sensors 45 are triggered in response to the positioning of a user's finger or thumb (or preprogrammed content) a signal is sent via an electrical connection 145 to an IC 150 included in the device 10. The IC 150 contains a processor(s) 155 and memory 160. The processor(s) 155 accesses preprogrammed signals and/or audio content stored on the memory 160 in the IC 150. The IC 150 further includes programming and electronic components to facilitate and direct audio content and control signals. The processor(s) 155 access the preprogrammed signals and/or audio content based on a program and/or in accordance to a user's input. The processor(s) 155 then generates a response that includes signals and may be in the form of audio or control signals. The IC 150 is in communication with each of the servos. From the processor(s) 155, audio signals may be transferred to an amplifier and speaker 51 (shown in FIG. 2B) while control signals are transferred to the servos to power in the desired direction. Further, as the servos are powered, movement is transferred to the linkages as described herein. Additionally, signals may be transferred to a targeting device (not shown) for activation. As a user triggers one or more of the plurality of sensors, the device 10 responds thereto and executes a nail polishing action while audio is played from the speaker, via audio content received by the amplifier. A power supply 165 is included in the device 10 to supply power where necessary. It should further be contemplated that the device 10 may have buttons in communication with the IC 150 to direct movement of the arm mechanism 15 without triggering the sensors.

In the first embodiment, the device 10 includes a means to move the plurality of linkages in accordance to a variety of preprogrammed responses triggered by sensors.

Further and in accordance with the first embodiment, the device 10 includes a means to paint and/or polish a user's nails in accordance to a variety of preprogrammed responses triggered by sensors.

The first embodiment of the device 10 also includes a means to prompt a user to adjust the positioning of a user's finger nail utilizing a targeting mechanism.

Additionally, the device 10 includes a means to trigger preprogrammed movements of the components of the device 10 while simultaneously outputting audio.

The first embodiment of the device 10 also includes a means to use RC components and to control and direct movement of the linkages and a user directed polishing pattern.

The first embodiment of the device 10 further includes a means to adjust the hand rest 20 in accordance a user's preference and to adjust linkage movements accordingly to facilitate accurate polishing.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. An automated nail polishing apparatus comprising:

a base enclosure having a base upper portion;

a hand rest secured along the base upper portion, wherein the hand rest is secured to the base enclosure by a height adjustable mechanism, the hand rest further having a first positioning groove along a top portion thereof, and a first sensor positioned within the first positioning groove;

a cap rotatably attached to the base upper portion at a position diametrically opposed to the hand rest, the cap is driven by a cap servo positioned within the base enclosure such that the cap is horizontally rotatable in clockwise and counterclockwise directions;

an arm mechanism pivotally secured at a lower end to an arm servo that is secured within the cap, the arm mechanism having a port about an upper end, the port removably receiving a brush attachment;

a receptacle removably attached to the base, the receptacle capable of holding a liquid; and an integrated circuit in communication with the first sensor, the cap servo, and arm servo, the integrated circuit further including preprogrammed content to control the cap servo and arm servo for moving the cap and arm, and wherein positioning a user's finger in the first positioning groove triggers the first sensor to send a signal to the integrated circuit to prompt the playback of preprogrammed content, said preprogrammed content being defined as controlling and moving the cap and arm mechanism such that the brush attachment is moved into the receptacle and then controlling and moving the cap and arm mechanism to apply any liquid on the brush attachment on a user's nail placed in the first positioning groove.

2. The apparatus of claim 1, wherein the hand rest includes a second positioning groove with a second sensor, and wherein the integrated circuit is further in communication with the second sensor, such that positioning a user's finger in the second positioning groove triggers the second sensor to send a signal to the integrated circuit to prompt the playback of a second preprogrammed content, said second preprogrammed content being defined as controlling and moving the cap and arm mechanism such that the brush attachment is moved into the receptacle and then controlling and moving the cap and arm mechanism to apply any liquid on the brush attachment on a user's nail placed in the second positioning groove.

3. The apparatus of claim 1, wherein the arm mechanism has a light source attached thereto to aid a user with visual alignment to improve accuracy of polish application.

4. The apparatus of claim 1, wherein the height adjustable mechanism of the hand rest includes a stem capable of adjusting vertically such that the hand rest pivots about a first end of the stem to provide multiple hand rest positions.

5. The apparatus of claim 1, wherein the port is capable of receiving a nail filing attachment.

6. The apparatus of claim 1, wherein the port is capable of receiving a nail buffer attachment.

7. The apparatus of claim 1 further comprising a speaker is included in the base and is in communication with the integrated circuit to facilitate audio output in accordance to the preprogrammed content and movement of the linkages.

* * * * *